US010026532B2

(12) United States Patent
Hidaka et al.

(10) Patent No.: US 10,026,532 B2
(45) Date of Patent: Jul. 17, 2018

(54) R-T-B BASED SINTERED MAGNET

(71) Applicant: TDK CORPORATION, Tokyo (JP)

(72) Inventors: Tetsuya Hidaka, Tokyo (JP); Takuma Hayakawa, Tokyo (JP); Makoto Iwasaki, Tokyo (JP); Ayato Kakoki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 48 days.

(21) Appl. No.: 15/285,113

(22) Filed: Oct. 4, 2016

(65) Prior Publication Data

US 2017/0103836 A1 Apr. 13, 2017

(30) Foreign Application Priority Data

Oct. 7, 2015 (JP) ..... 2015-199488

(51) Int. Cl.

| | |
|---|---|
| ***H01F 1/00*** | (2006.01) |
| ***H01F 1/057*** | (2006.01) |
| ***C22C 38/00*** | (2006.01) |
| ***C22C 38/04*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| ***H01F 1/058*** | (2006.01) |
| ***H01F 41/02*** | (2006.01) |

(52) U.S. Cl.

CPC ..... *H01F 1/0577* (2013.01); *C22C 38/002* (2013.01); *C22C 38/005* (2013.01); *C22C 38/04* (2013.01); *C22C 38/06* (2013.01); *C22C 38/10* (2013.01); *C22C 38/14* (2013.01); *C22C 38/16* (2013.01); *H01F 1/058* (2013.01); *H01F 41/0293* (2013.01)

(58) Field of Classification Search

None

See application file for complete search history.

(56) References Cited

U.S. PATENT DOCUMENTS

| | | | | |
|---|---|---|---|---|
| 4,975,213 | A * | 12/1990 | Sakai | C22C 1/0441 148/302 |
| 5,213,631 | A * | 5/1993 | Akioka | B22F 9/023 148/302 |
| 5,595,608 | A * | 1/1997 | Takebuchi | H01F 1/0577 148/103 |
| 5,872,501 | A * | 2/1999 | Hamano | C22C 1/0441 148/104 |
| 7,985,303 | B2 * | 7/2011 | Nagata | H01F 1/0577 148/101 |
| 8,012,269 | B2 * | 9/2011 | Yamamoto | C22C 38/002 148/101 |
| 2008/0245442 | A1 | 10/2008 | Nakamura et al. | |
| 2008/0286595 | A1 * | 11/2008 | Yoshimura | B22F 7/062 428/548 |
| 2010/0233016 | A1 | 9/2010 | Tsubokura et al. | |
| 2011/0025440 | A1 | 2/2011 | Kuniyoshi et al. | |
| 2011/0150691 | A1 | 6/2011 | Nakamura et al. | |
| 2011/0279205 | A1 * | 11/2011 | Fukui | C22C 38/002 335/302 |
| 2012/0021221 | A1 * | 1/2012 | Miyoshi | B82Y 25/00 428/402 |
| 2017/0365384 | A1 * | 12/2017 | Hirota | H01F 1/059 |

FOREIGN PATENT DOCUMENTS

| | | | |
|---|---|---|---|
| CN | 101542644 | A | 9/2009 |
| CN | 101981634 | A | 2/2011 |
| JP | 2006-210893 | A | 8/2006 |
| WO | 2006/043348 | A1 | 4/2006 |

* cited by examiner

*Primary Examiner* — Kevin M Bernatz

(74) *Attorney, Agent, or Firm* — Oliff PLC

(57) ABSTRACT

An R-T-B based sintered magnet includes "R", "T", and "B". "R" represents a rare earth element. "T" represents a metal element other than rare earth elements including at least Fe, Cu, Mn, Al, Co, Ga, and Zr. "B" represents boron or boron and carbon. With respect to 100 mass % of a total mass of the R-T-B based sintered magnet, a content of "R" is 28.0 to 31.5 mass %, a content of Cu is 0.04 to 0.50 mass %, a content of Mn is 0.02 to 0.10 mass %, a content of Al is 0.15 to 0.30 mass %, a content of Co is 0.50 to 3.0 mass %, a content of Ga is 0.08 to 0.30 mass %, a content of Zr is 0.10 to 0.25 mass %, and a content of "B" is 0.85 to 1.0 mass %.

7 Claims, 6 Drawing Sheets

R-T-B BASED SINTERED MAGNET

BACKGROUND OF THE INVENTION

1. Field of the Invention

The present invention relates to an R-T-B based sintered magnet.

2. Description of the Related Art

Rare earth sintered magnets having an R-T-B based composition are a magnet having excellent magnetic properties and are under intensive investigations for further improvement of the magnetic properties thereof. In general, the residual magnetic flux density (residual magnetization) Br and the coercivity HcJ are used as a parameter to indicate the magnetic properties. Magnets having high values for these properties can be said to have excellent magnetic properties.

For example, Patent Document 1 discloses an Nd—Fe—B based rare earth sintered magnet having favorable magnetic properties.

Patent Document 2 discloses a rare earth sintered magnet obtained by immersing a magnet body in a slurry prepared by dispersing a fine powder containing various kinds of rare earth elements in water or an organic solvent and then heating it to conduct the grain boundary diffusion.

Patent Document 1: JP 2006-210893 A

Patent Document 2: WO 06/43348 A

SUMMARY OF THE INVENTION

An object of the present invention is to provide an R-T-B based sintered magnet having high residual magnetic flux density Br and coercivity HcJ, exhibiting excellent corrosion resistance and manufacturing stability, and further having a small decrease value of residual magnetic flux density Br and a large increment value of coercivity HcJ at the time of grain boundary diffusion of a heavy rare earth element.

In order to achieve the above object, the R-T-B based sintered magnet of the present invention includes "R", "T", and "B", wherein "R" represents a rare earth element, "T" represents a metal element other than rare earth elements including at least Fe, Cu, Mn, Al, Co, Ga, and Zr, "B" represents boron or boron and carbon, a content of "R" is 28.0 to 31.5 mass % with respect to 100 mass % of a total mass of the R-T-B based sintered magnet, a content of Cu is 0.04 to 0.50 mass % with respect to 100 mass % of a total mass of the R-T-B based sintered magnet, a content of Mn is 0.02 to 0.10 mass % with respect to 100 mass % of a total mass of the R-T-B based sintered magnet, a content of Al is 0.15 to 0.30 mass % with respect to 100 mass % of a total mass of the R-T-B based sintered magnet, a content of Co is 0.50 to 3.0 mass % with respect to 100 mass % of a total mass of the R-T-B based sintered magnet, a content of Ga is 0.08 to 0.30 mass % with respect to 100 mass % of a total mass of the R-T-B based sintered magnet, a content of Zr is 0.10 to 0.25 mass % with respect to 100 mass % of a total mass of the R-T-B based sintered magnet, and a content of "B" is 0.85 to 1.0 mass % with respect to 100 mass % of a total mass of the R-T-B based sintered magnet.

The R-T-B based sintered magnet of the present invention has the above features, and thus can improve residual magnetic flux density and coercivity and obtain high corrosion resistance and manufacturing stability. Furthermore, the R-T-B based sintered magnet of the present invention can further enhance the effect at the time of grain boundary diffusion of a heavy rare earth element. Specifically, the R-T-B based sintered magnet of the present invention can reduce a decrease value of residual magnetic flux density Br due to diffusion of a heavy rare earth element more than that of conventional products, and can increase an increment value of coercivity HcJ due to diffusion of a heavy rare earth element more than that of conventional products.

In the R-T-B based sintered magnet of the present invention, "R" may include a heavy rare earth element consisting of substantially only Dy.

In the R-T-B based sintered magnet of the present invention, "R" may not substantially include a heavy rare earth element.

In the R-T-B based sintered magnet of the present invention, Ga/Al is preferably 0.60 or more and 1.30 or less by mass ratio.

The R-T-B based sintered magnet of the present invention includes an R-T-B based sintered magnet where a heavy rare earth element is dispersed in a grain boundary of the R-T-B based sintered magnet.

DESCRIPTION OF THE PREFERRED EMBODIMENTS

Figure 1:
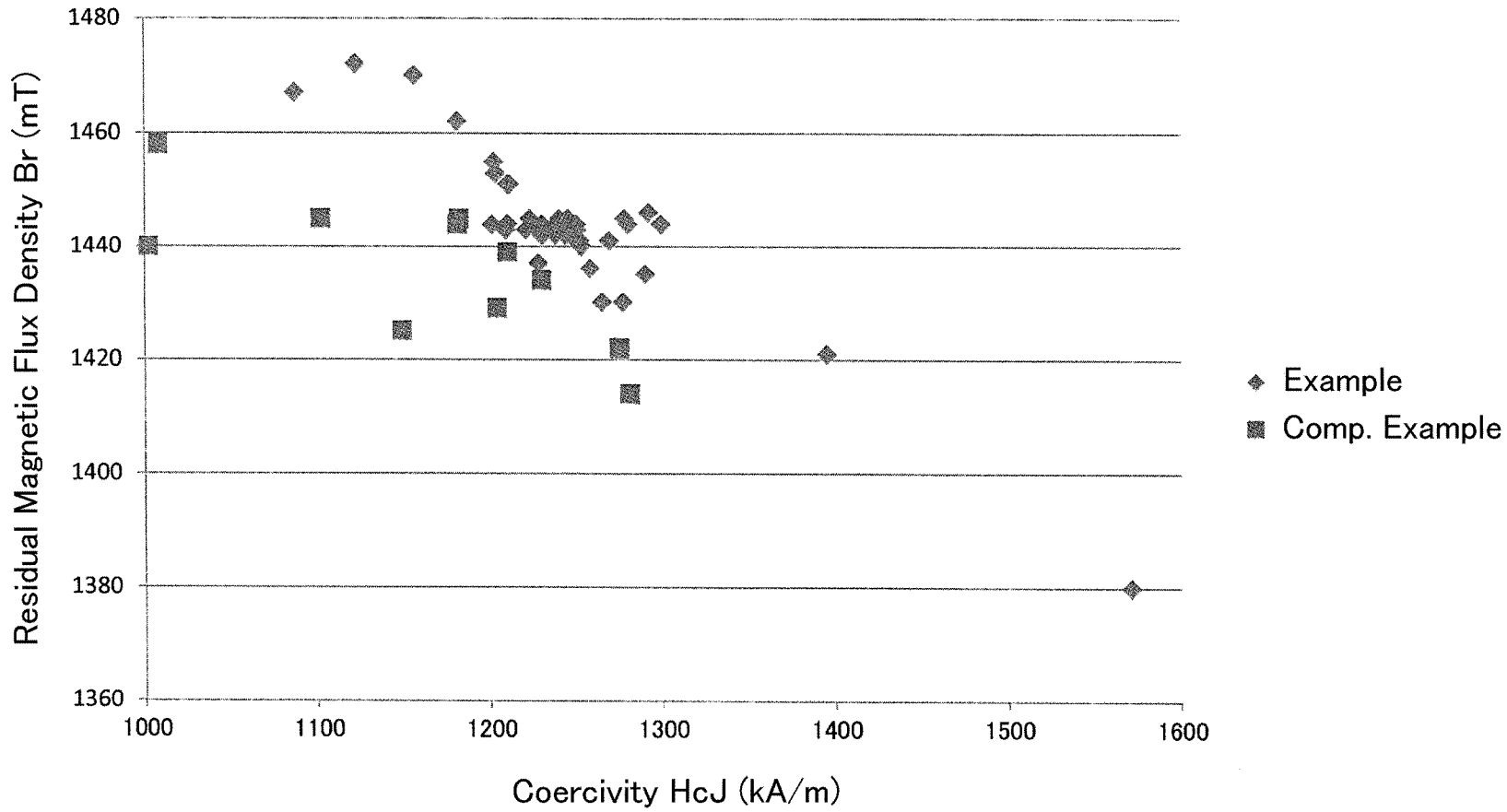
FIG. 1 is a Br-HcJ map in Experimental Example 1.

Hereinafter, the present invention will be described with reference to embodiments illustrated in the drawings.

<R-T-B Based Sintered Magnet>

The R-T-B based sintered magnet according to the present embodiment has grains composed of $R_2T_{14}B$ crystals and grain boundaries. The residual magnetic flux density Br, the coercivity HcJ, the corrosion resistance, and the manufacturing stability can be improved by containing a plurality of specific elements in a specific range of contents. Furthermore, it is possible to reduce a decrease value of residual magnetic flux density Br and increase an increment value of coercivity HcJ in the grain boundary diffusion described later. That is, the R-T-B based sintered magnet according to the present embodiment has excellent magnetic properties with or without a grain boundary diffusion step. The element to be diffused in the grain boundary diffusion is preferably a heavy rare earth element from the viewpoint of improving the coercivity HcJ.

"R" represents a rare earth element. The rare earth elements include Sc, Y, and Lanthanide elements belonging to the third group in the long-form periodic table. The Lanthanide elements include, for example, La, Ce, Pr, Nd, Sm, Eu, Gd, Tb, Dy, Ho, Er, Tm, Yb, and Lu. In the R-T-B based sintered magnet according to the present embodiment, "R" preferably contains Nd, Pr, or Dy.

The content of "R" in the R-T-B based sintered magnet according to the present embodiment is 28.0 mass % or more and 31.5 mass % or less with respect to 100 mass % of the entire R-T-B based sintered magnet. The coercivity HcJ decreases when the content of "R" is less than 28.0 mass %. The residual magnetic flux density Br decreases when the content of "R" exceeds 31.5 mass %. The content of "R" is preferably 29.0 mass % or more and 31.0 mass % or less.

Furthermore, in the R-T-B based sintered magnet of the present embodiment, "R" may contain heavy rare earth elements substantially consisting of only Dy. This makes it possible to efficiently improve the magnetic properties at the time of grain boundary diffusion of the heavy rare earth element (particularly Tb). Incidentally, what "R" contains heavy rare earth elements substantially consisting of only Dy means that the content of Dy is 98 mass % or more with respect to 100 mass % of the entire heavy rare earth elements.

Furthermore, in the R-T-B based sintered magnet of the present embodiment, "R" may not substantially contain a heavy rare earth element. This can obtain an R-T-B based sintered magnet having high residual magnetic flux density Br at low cost. Furthermore, this can most efficiently improve the magnetic properties at the time of grain boundary diffusion of the heavy rare earth element (particularly Tb). Incidentally, what "R" does not substantially contain a heavy rare earth element means that the content of the heavy rare earth element is 1.5 mass % or less with respect to 100 mass % of the entire "R".

"T" represents an element such as a metal element other than rare earth elements. In the R-T-B based sintered magnet according to the present embodiment, "T" contains at least Fe, Co, Cu, Al, Mn, Ga, and Zr. For example, "T" may further contain one or more kinds of elements among the elements such as metal elements such as Ti, V, Cr, Ni, Nb, Mo, Ag, Hf, Ta, W, Si, P, Bi, and Sn.

The content of Fe in the R-T-B based sintered magnet according to the present embodiment is substantially the remainder in the constituents of the R-T-B based sintered magnet.

The content of Co is 0.50 mass % or more and 3.0 mass % or less. The corrosion resistance is improved by containing Co. The corrosion resistance of the R-T-B based sintered magnet to be finally obtained deteriorates when the content of Co is less than 0.50 mass %. The cost increases as well as the effect of improving the corrosion resistance reaches the peak when the content of Co exceeds 3.0 mass %. The content of Co is preferably 1.0 mass % or more and 2.5 mass % or less.

The content of Cu is 0.04 mass % or more and 0.50 mass % or less. When the content of Cu is less than 0.04 mass %, the coercivity HcJ decreases, and a coercivity improvement value ΔHcJ after the diffusion of the rare earth element (so-called after applying a grain boundary diffusion method) becomes insufficient. When the content of Cu exceeds 0.50 mass %, the effect of the improvement in the coercivity HcJ is saturated, and the residual magnetic flux density Br decreases. In addition, the content of Cu is preferably 0.10 mass % or more and 0.50 mass % or less. The coercivity improvement value ΔHcJ means a difference between HcJ after the grain boundary diffusion step and HcJ before the grain boundary diffusion step.

The content of Al is 0.15 mass % or more and 0.40 mass % or less. When the content of Al is less than 0.15 mass %, the coercivity HcJ decreases, and a coercivity improvement value ΔHcJ after the diffusion of the rare earth element becomes insufficient. Furthermore, the change in magnetic properties (particularly coercivity HcJ) with respect to the change in aging temperature to be described later increases, and thus the fluctuation in properties at the time of mass production increases. That is, the manufacturing stability decreases. When the content of Al exceeds 0.40 mass %, the residual magnetic flux density Br decreases. Furthermore, the residual magnetic flux density improvement value ΔBr becomes large, and the temperature change rate of the coercivity HcJ increases. The content of Al is preferably 0.18 mass % or more and 0.30 mass % or less. The residual magnetic flux density improvement value ΔBr means a difference between Br after the grain boundary diffusion step and Br before the grain boundary diffusion step.

Here, ΔBr will be described in more detail. The residual magnetic flux density Br generally decreases due to the diffusion of the heavy rare earth element. That is, ΔBr is a negative value, where ΔBr is denoted as an improvement value of residual magnetic flux density Br. As described above, ΔBr becomes large when the content of Al exceeds 0.40 mass %. The fact that ΔBr becomes large means that the magnetic properties deteriorate.

The content of Mn is 0.02 mass % or more and 0.10 mass % or less. When the content of Mn is less than 0.02 mass %, the residual magnetic flux density Br decreases, a coercivity improvement value ΔHcJ after the diffusion of the rare earth element becomes insufficient. When the content of Mn exceeds 0.10 mass %, the coercivity HcJ decreases, and a coercivity improvement value ΔHcJ after the diffusion of the rare earth element becomes insufficient. The content of Mn is preferably 0.02 mass % or more and 0.06 mass % or less.

The content of Ga is 0.08 mass % or more and 0.30 mass % or less. The coercivity is sufficiently improved by containing Ga at 0.08 mass % or more. The effect of the improvement in the coercivity HcJ due to containing Ga is small when the content of Ga is less than 0.08 mass %. When the content of Ga exceeds 0.30 mass %, a different phase is likely to be generated at the time of aging treatment, and the residual magnetic flux density Br decreases. The content of Ga is preferably 0.10 mass % or more and 0.25 mass % or less.

The content of Zr is 0.10 mass % or more and 0.25 mass % or less. The abnormal grain growth at the time of sintering is reduced and the squareness ratio (Hk/HcJ) and magnetizing rate in a low magnetic field are improved by containing Zr. When the content of Zr is less than 0.10 mass %, an effect of reduction in abnormal grain growth at the time of sintering due to containing Zr is small, and the squareness ratio (Hk/HcJ) and magnetizing rate in a low magnetic field are poor. When the content of Zr exceeds 0.25 mass %, an effect of reduction in abnormal grain growth at the time of sintering is saturated, and the residual magnetic flux density Br decreases. The content of Zr is preferably 0.13 mass % or more and 0.22 mass % or less. Hk denotes a magnetic field value point at the intersection of the demagnetization curve of second quadrant and 90% line of the residual magnetic density Br.

In addition, Ga/Al is preferably 0.60 or more and 1.30 or less. This improves the coercivity HcJ and increases an improvement value of coercivity HcJ after the diffusion of the rare earth element. Furthermore, this decreases the change in magnetic properties (particularly coercivity HcJ) with respect to the change in aging temperature described later, and decreases the fluctuation in properties at the time of mass production. That is, the manufacturing stability increases.

The term "B" in the "R-T-B based sintered magnet" according to the present embodiment represents boron (B) or boron (B) and carbon (C). That is, in the R-T-B based sintered magnet according to the present embodiment, a portion of boron (B) may be substituted with carbon (C).

The content of "B" in the R-T-B based sintered magnet according to the present embodiment is 0.85 mass % or more and 1.0 mass % or less. High squareness ratio is hard to be achieved when "B" is less than 0.85 mass %. That is, the squareness ratio Hk/HcJ is hard to be improved. The residual magnetic flux density Br decreases when "B" is 1.0 mass % or more. In addition, the content of "B" is preferably 0.90 mass % or more and 1.0 mass % or less.

The preferred content of carbon (C) in the R-T-B based sintered magnet according to the present embodiment varies depending on other parameters, but it is generally in a range of 0.05 to 0.15 mass %.

In the R-T-B based sintered magnet according to the present embodiment, the amount of nitrogen (N) is preferably 100 to 1000 ppm, even more preferably 200 to 800 ppm, and particularly preferably 300 to 600 ppm.

Incidentally, a conventionally generally known method can be used for measuring the various kinds of components contained in the R-T-B based sintered magnet according to the present embodiment. The amounts of the various kinds of metal elements are measured, for example, by fluorescent X-ray analysis and inductively coupled plasma emission spectroscopic analysis (ICP analysis). The amount of oxygen is measured, for example, by an inert gas fusion-nondispersive infrared absorption method. The amount of carbon is measured, for example, by a combustion in oxygen stream-infrared absorption method. The amount of nitrogen is measured, for example, by an inert gas fusion-thermal conductivity method.

The R-T-B based sintered magnet according to the present embodiment has any shape, such as a rectangular parallelepiped shape.

Hereinafter, the method for manufacturing an R-T-B based sintered magnet will be described in detail, but known methods may be used for matters that are not specifically stated.

[Preparation Step of Raw Material Powder]

The raw material powder can be fabricated by a known method. In the present embodiment, one alloy method using a single alloy will be described, but a so-called two alloy method, which a raw material powder is fabricated by mixing two or more kinds of alloys such as the first alloy and the second alloy of different compositions, may be used.

First, an alloy that mainly forms the main phase of the R-T-B based sintered magnet is prepared (alloy preparation step). In the alloy preparation step, an alloy having a desired composition is fabricated by melting the raw material metal corresponding to the composition of the R-T-B based sintered magnet according to the present embodiment by a known method and then casting it.

As the raw material metal, for example, it is possible to use a rare earth metal or a rare earth alloy, pure iron, ferroboron, and further an alloy or a compound of these. The method for casting the raw material metal is not particularly limited. A strip casting method is preferable in order to obtain an R-T-B based sintered magnet having high magnetic properties. The raw material alloy thus obtained may be subjected to homogenization by a known manner, if necessary.

The alloy is pulverized after being fabricated (pulverization step). Incidentally, the atmosphere in each step from the pulverization step to the sintering step is preferably set to have a low oxygen concentration avoiding from oxidation. Thus, high magnetic properties can be obtained. For example, it is preferable to set the concentration of oxygen in each step to 200 ppm or less.

Hereinafter, the pulverization step conducted by two stages of a coarse pulverization step to pulverize the raw material alloy so as to have a particle diameter of about from several hundreds μm to several mm and a fine pulverization step to pulverize the raw material alloy so as to have a particle diameter of about several μm is described, but the pulverization step may be conducted by one stage of only the fine pulverization step.

In the coarse pulverization step, the raw material alloy is coarsely pulverized so as to have a particle diameter of about several hundreds μm to several mm. A coarsely pulverized powder is hereby obtained. The method for the coarse pulverization is not particularly limited, and the coarse pulverization can be conducted by any known method, such as a method conducting hydrogen storage pulverization and a method using a coarse pulverizer.

Next, the coarsely pulverized powder thus obtained is finely pulverized so as to have an average particle diameter of about several μm (fine pulverization step). A finely pulverized powder is hereby obtained. The average particle diameter of the finely pulverized powder is preferably 1 μm or more and 10 μm or less, more preferably 2 μm or more and 6 μm or less, and even more preferably 3 μm or more and 5 μm or less.

The method for the fine pulverization is not particularly limited. For example, the fine pulverization is conducted by a method using various kinds of fine pulverizers.

When finely pulverizing the coarsely pulverized powder, a finely pulverized powder exhibiting high orientation at the time of pressing can be obtained by adding various kinds of pulverization aids such as lauric acid amide and oleic acid amide.

[Pressing Step]

In the pressing step, the finely pulverized powder is pressed into the intended shape. The pressing step is not particularly limited, but in the present embodiment, the finely pulverized powder is filled in a mold and pressurized in a magnetic field. In the green compact thus obtained, the main phase crystal is oriented in a specific direction, and thus an R-T-B based sintered magnet having a higher residual magnetic flux density is obtained.

The pressure of 20 MPa to 300 MPa may be applied. The magnetic field of 950 kA/m to 1600 kA/m may be applied. The magnetic field to be applied is not limited to a static magnetic field, and may be a pulsed magnetic field. It is also possible to concurrently use a static magnetic field and a pulsed magnetic field.

Incidentally, as the pressing method, it is possible to apply wet pressing to press a slurry prepared by dispersing the finely pulverized powder in a solvent such as oil in addition to dry pressing to press the finely pulverized powder as it is as described above.

The green compact obtained by pressing the finely pulverized powder can have any shape. The density of the green compact at this time point is preferably set to 4.0 to 4.3 $Mg/m^3$.

[Sintering Step]

The sintering step is a step to obtain a sintered body by sintering the green compact in a vacuum or an inert gas atmosphere. The sintering temperature is required to be adjusted depending on the conditions such as the composition, the pulverization method, the particle diameter, and the particle diameter distribution, but for example, the green compact is sintered by being heated for 1 hour or longer and 20 hours or shorter at 1000° C. or higher and 1200° C. or lower in a vacuum or in the presence of an inert gas. A sintered body having a high density is hereby obtained. In the present embodiment, a sintered body having a density of at least 7.48 $Mg/m^3$ or more, preferably 7.50 $Mg/m^3$ or more, is obtained.

[Aging Treatment Step]

The aging treatment step is a step to heat the sintered body at a temperature lower than the sintering temperature. The aging treatment may be conducted or may not be conducted. The number of aging treatments is not particularly limited either. The aging treatment is appropriately conducted according to the desired magnetic properties. A grain boundary diffusion step described later may also serve as the aging treatment step. In the R-T-B based sintered magnet according to the present embodiment, it is the most preferable to conduct two aging treatments. Hereinafter, an embodiment to conduct two aging treatments will be described.

The aging step of the first time is denoted as the first aging step, and the aging step of the second time is denoted as the second aging step. The aging temperature in the first aging step is denoted as T1, and the aging temperature in the second aging step is denoted as T2.

The temperature T1 and aging time in the first aging step are not particularly limited, but are preferably 700° C. or higher and 900° C. or lower and 1 to 10 hours.

The temperature T2 and aging time in the second aging step are not particularly limited, but are preferably a temperature of 450° C. or higher and 700° C. or lower and 1 to 10 hours.

These aging treatments can improve the magnetic properties, particularly, the coercivity HcJ of the R-T-B based sintered magnet to be finally obtained.

The manufacturing stability of the R-T-B based sintered magnet according to the present embodiment can be confirmed by the difference of magnetic properties with respect to the change in aging temperature. For example, when the difference of magnetic properties with respect to the change in aging temperature is large, the magnetic properties change as the aging temperature slightly changes. Hence, the range of the aging temperature allowed in the aging step is narrow, and thus the manufacturing stability decreases. In contrast, when the amount of change in magnetic properties with respect to the change in aging temperature is small, the magnetic properties hardly change even if the aging temperature changes. Hence, the range of the aging temperature allowed in the aging step is broad, and thus the manufacturing stability increases.

The R-T-B based sintered magnet according to the present embodiment thus obtained has the desired properties. Specifically, it has a high residual magnetic flux density Br and a high coercivity HcJ, and also exhibits excellent corrosion resistance and excellent manufacturing stability. Furthermore, when conducting a grain boundary diffusion step described later, a decrease value of residual magnetic flux density is small and an improvement value of coercivity is large at the time of grain boundary diffusion of the heavy rare earth element. That is, the R-T-B based sintered magnet according to the present embodiment is a magnet suitable for grain boundary diffusion.

Incidentally, the R-T-B based sintered magnet according to the present embodiment obtained by the method described above is magnetized so as to be an R-T-B based sintered magnet product.

The R-T-B based sintered magnet according to the present embodiment is suitably used for applications such as a motor and an electrical generator.

Incidentally, the present invention is not limited to the embodiments described above, but can be variously modified within the scope thereof.

Hereinafter, the method for grain boundary diffusion of the heavy rare earth element in the R-T-B based sintered magnet according to the present embodiment will be described.

[Machining Step (Before Grain Boundary Diffusion)]

There may be a step to machine the R-T-B based sintered magnet according to the present embodiment into a desired shape, if necessary. Examples of the machining method may include a shaping process such as cutting and grinding and chamfering such as barrel polishing.

[Grain Boundary Diffusion Step]

Hereinafter, the method for grain boundary diffusion of the heavy rare earth element into the R-T-B based sintered magnet according to the present embodiment will be described.

The grain boundary diffusion can be conducted by depositing a compound or alloy containing a heavy rare earth element on the surface of the sintered body subjected to a pretreatment if necessary by coating, vapor deposition, or the like and then heating the resultant sintered body. The grain boundary diffusion of the heavy rare earth element can further improve the coercivity HcJ of the R-T-B based sintered magnet to be finally obtained.

Incidentally, the matters of the pretreatment are not particularly limited. Examples thereof may include a pretreatment in which the sintered body is etched by a known method, then washed, and dried.

As the heavy rare earth element, Dy or Tb is preferable, and Tb is more preferable.

In the present embodiment described below, a coating material containing the heavy rare earth element is prepared, and the coating material is coated on the surface of the sintered body.

The aspect of the coating material is not particularly limited. There is no limitation for the compound containing the heavy rare earth element and the alloy to be used and the solvent or dispersion medium to be used. The kind of solvent or dispersion medium is not particularly limited either. The concentration of the coating material is not particularly limited either.

The temperature for diffusion treatment in the grain boundary diffusion step according to the present embodiment is preferably 800 to 950° C. The time for diffusion treatment is preferably 1 to 50 hours.

The manufacturing stability of the R-T-B based sintered magnet according to the present embodiment can be confirmed by the degree of the amount of change in magnetic properties with respect to the change in temperature for diffusion treatment in the grain boundary diffusion step. For example, when the amount of change in magnetic properties with respect to the change in temperature for diffusion treatment is large, the magnetic properties change as the temperature for diffusion treatment slightly changes. Hence, the range of the temperature for diffusion treatment allowed in the grain boundary diffusion step is narrow, and thus the manufacturing stability decreases. In contrast, when the amount of change in magnetic properties with respect to the change in temperature for diffusion treatment is small, the magnetic properties hardly change even if the temperature for diffusion treatment changes. Hence, the range of the temperature for diffusion treatment allowed in the grain boundary diffusion step is broad, and thus the manufacturing stability increases.

A heat treatment may be further conducted after the diffusion treatment. The temperature for heat treatment in this case is preferably 450 to 600° C. The time for heat treatment is preferably 1 to 10 hours.

[Machining Step (After Grain Boundary Diffusion)]

It is preferable to conduct polishing in order to remove the coating material remaining on the surface of the principal plane after the grain boundary diffusion step.

The kind of machining to be conducted in the machining step after the grain boundary diffusion is not particularly limited. For example, a shaping process such as cutting and grinding or chamfering such as barrel polishing may be conducted after the grain boundary diffusion.

Incidentally, in the present embodiment, the machining step is conducted before and after the grain boundary diffusion, but these steps are not required to be necessarily conducted. In addition, the grain boundary diffusion step may also serve as the aging step when finally obtaining the R-T-B based sintered magnet after the grain boundary diffusion. The heating temperature in a case in which the grain boundary diffusion step also serves as the aging step is not particularly limited. The temperature is a preferred temperature in the grain boundary diffusion step, and it is particularly preferable to conduct the aging step at a preferred temperature as well.

EXAMPLES

Hereinafter, the present invention will be described with reference to further detailed Examples, but is not limited to these Examples.

Experimental Example 1

(Fabrication of Rare Earth Sintered Magnet Base Material (Rare Earth Sintered Magnet Body))

As raw materials, Nd, Pr (purity of 99.5% or more), a Dy—Fe alloy, electrolytic iron, and a low-carbon ferroboron alloy were prepared. Furthermore, Al, Ga, Cu, Co, Mn, and Zr were prepared in the form of a pure metal or an alloy with Fe.

Alloys for sintered body (raw material alloys) were fabricated from the raw materials by the strip casting method so that the magnet compositions to be finally obtained are the respective compositions presented in Table 1 and Table 2. Here, it was found from comparison between the composition of the raw material alloys and the magnet composition to be finally obtained that the amount of "R" of the magnet composition to be finally obtained decreased by about 0.3% more than the amount of "R" of the composition of the raw material alloys. In this case, it appeared that only the amount of Nd, which particularly largely occupies "R", decreased by about 0.3%. The alloy thickness of the raw material alloys was set to 0.2 to 0.4 mm.

Subsequently, hydrogen was stored in the raw material alloy by allowing a hydrogen gas to flow through the raw material alloy for 1 hour at room temperature. Subsequently, the atmosphere was switched to an Ar gas, and the dehydrogenation treatment was conducted for 1 hour at 600° C., thereby conducting the hydrogen pulverization of the raw material alloy. Furthermore, the resultant was cooled and then screened by using a sieve so as to obtain a powder having a grain size of 425 μm or less. Incidentally, a low-oxygen atmosphere having an oxygen concentration of less than 200 ppm was maintained all the time from the hydrogen pulverization to the sintering step described later.

Subsequently, oleic acid amide as a pulverization aid was added to the powder of the raw material alloy after the hydrogen pulverization at 0.1% by mass ratio and mixed.

Subsequently, the powder of the raw material alloy thus obtained was finely pulverized in a nitrogen stream by using an impact plate type jet mill apparatus to obtain a fine powder having an average particle diameter of 3.9 to 4.2 μm. Incidentally, the average particle diameter D50 is the average particle diameter measured by a laser diffraction type particle size analyzer.

The fine powder thus obtained was evaluated by using fluorescent X-ray. Only boron (B) was measured by ICP. It was confirmed that the composition of the fine powder of each sample was as described in Table 1 and Table 2. The composition of the fine powder and the magnet composition to be finally obtained substantially correspond to each other.

Incidentally, H, Si, Ca, La, Ce, Cr, and the like may be detected in addition to O, N, and C among the elements that are not described in Table 1 or Table 2. Si is mainly mixed from the ferroboron raw material and the crucible at the time of melting the alloy. Ca, La, and Ce are mixed from the rare earth raw material. Cr may be mixed from electrolytic iron.

The fine powder thus obtained was pressed in a magnetic field to press a green compact. The magnetic field applied at this time was a static magnetic field of 1200 kA/m. The pressure applied at the time of pressing was 98 MPa. Incidentally, the magnetic field applying direction and the pressurizing direction were set to cross at right angles. The density of the green compact at this time was measured, and the density of all the green compacts was within a range of 4.10 to 4.25 $Mg/m^3$.

Next, the green compact was sintered to obtain a rare earth sintered magnet base material (hereinafter, also simply referred to as the base material). Although the optimum condition of the sintering condition is different according to the composition or the like, that the green compact was retained for 4 hours at a temperature in a range of 1040 to 1100° C. The sintering atmosphere was a vacuum. The density of the sintered body at this time was in a range of 7.51 to 7.55 $Mg/m^3$. Thereafter, at atmospheric pressure in an Ar atmosphere, the first aging treatment was conducted for 1 hour at the first aging temperature T1 of 850° C., and further the second aging treatment was conducted for 1 hour at the second aging temperature T2 of 520° C.

Thereafter, the base material was machined into 14 mm×10 mm×11 mm by a Surface Grinding Machine, and the magnetic properties thereof were evaluated by a BH tracer. Incidentally, the R-T-B based sintered magnets were magnetized in a pulse magnetic field of 4000 kA/m before the measurement. The results are shown in Table 1 and Table 2.

Figure 2:
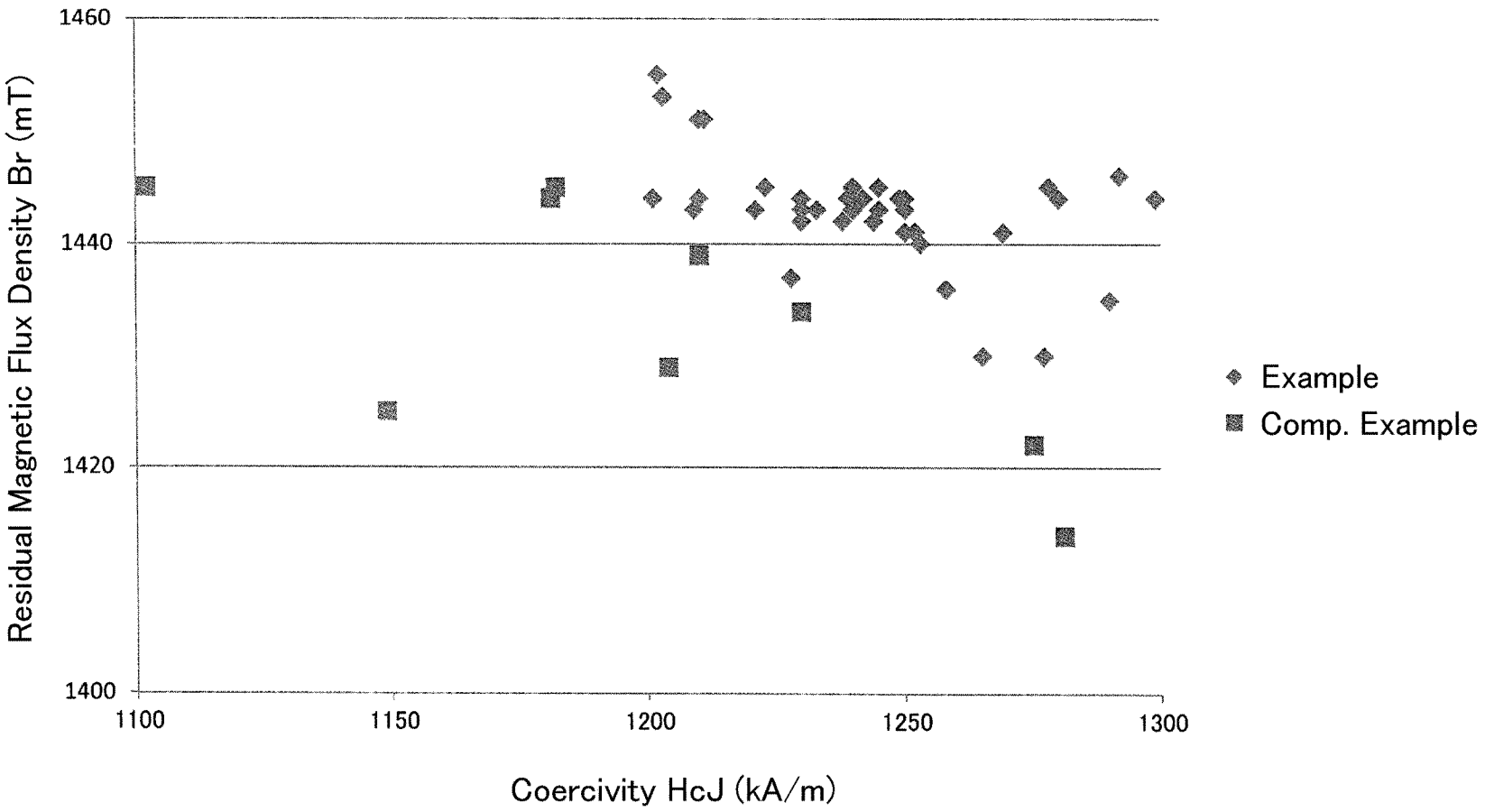
FIG. 2 is a Br-HcJ map in Experimental Example 1.

The residual magnetic flux density Br and coercivity HcJ were evaluated in a comprehensive manner. Specifically, all Examples and all Comparative Examples described in Table 1 and Table 2 were plotted on a Br-HcJ map (graph taking Br in the vertical axis and HcJ in the horizontal axis). Samples on more upper-right side of the Br-HcJ map have more favorable Br and HcJ. FIG. 1 is the Br-HcJ map made from Table 1 and Table 2, and FIG. 2 is the Br-HcJ map made by enlarging the place where a large number of samples are plotted in FIG. 1. In Table 1 and Table 2, samples having favorable Br and HcJ are denoted as ○, and samples having unfavorable Br and HcJ are denoted as ×. Incidentally, Comparative Examples (Comparative Examples 1, 3a, 6, and 9), which have favorable Br and HcJ and unfavorable ΔBr, ΔHjJ, corrosion resistance, or squareness ratio, are not illustrated in FIG. 1 or FIG. 2 in order to clarify that all Examples have favorable Br and HcJ.

A squareness ratio of 97% or more is denoted as being favorable in the present Example. In Table 1, a squareness ratio is described with respect to only Example 2, Examples 24a and 24 to 27 whose Zr is changed from Example 2, and Comparative Example 8 and 9. This is because the squareness ratio is not largely affected by the amount of elements other than Zr, and the square ratio of the other samples having the amount of Zr equal to that of Example 2 is approximately as favorable as Example 2.

In addition, the respective samples were subjected to a corrosion resistance test. The corrosion resistance test was conducted by a Pressure Cooker Test (PCT) at a saturated vapor pressure. Specifically, the R-T-B based sintered magnet was left for 1000 hours at 2 atm in an environment of 100% RH, and the change in mass before and after the test was measured. A mass change by 3 mg/cm$^2$ or less was considered to exhibit favorable corrosion resistance. The results are shown in Table 1 and Table 2. Samples exhibiting favorable corrosion resistance are denoted as ○, and samples exhibiting unfavorable corrosion resistance are denoted as ×.

(Tb Diffusion)

Furthermore, a treatment in which the sintered body obtained in the step described above was machined to have a thickness of 4.2 mm in easy magnetization direction. Then, this sintered body was immersed in a mixed solution of nitric acid and ethanol composed of ethanol at 100 mass % and nitric acid at 3 mass % for 3 minutes and immersed in ethanol for 1 minute was conducted two times, thereby conducting the etching treatment of the sintered body. Subsequently, a slurry prepared by dispersing $TbH_2$ grains (average particle diameter D50=10.0 μm) in ethanol was coated on the entire surface of the base material after the etching treatment so that a mass ratio of Tb to the magnet mass was 0.6 mass %.

After being coated with the slurry, the base material was subjected to the diffusion treatment for 18 hours at 930° C. while allowing Ar to flow at atmospheric pressure and then subjected to the heat treatment for 4 hours at 520° C.

The surface of the base material after the heat treatment was scraped off by 0.1 mm per each plane, and the magnetic properties thereof were evaluated by a BH tracer. The thickness of the base material is thin, and thus three sheets of the base material were overlapped for the evaluation. Then, a change value from before the diffusion was calculated. The results are shown in Table 1 and Table 2. Incidentally, in Experimental Example 1, a decrease value of residual magnetic flux density due to Tb diffusion, that is, an absolute value of ΔBr having 10 mT or less was considered to be favorable. As for a coercivity change value ΔHcJ due to Tb diffusion, ΔHcJ≥600 kA/m was considered to be favorable.

TABLE 1

| | Composition of R-T-B magnet (before Tb diffusion) | | | | | | | | |
|---|---|---|---|---|---|---|---|---|---|
| Sample number | Nd (mass %) | B (mass %) | Al (mass %) | Ga (mass %) | Cu (mass %) | Co (mass %) | Mn (mass %) | Zr (mass %) | Ga/Al |
| Comp. Example 1 | 30.7 | 0.95 | 0.12 | 0.20 | 0.20 | 2.00 | 0.04 | 0.15 | 1.67 |
| Example 1 | 30.7 | 0.95 | 0.15 | 0.20 | 0.20 | 2.00 | 0.04 | 0.15 | 1.25 |
| Example 1a | 30.7 | 0.95 | 0.16 | 0.20 | 0.20 | 2.00 | 0.04 | 0.15 | 1.25 |
| Example 2 | 30.7 | 0.95 | 0.20 | 0.20 | 0.20 | 2.00 | 0.04 | 0.15 | 1.00 |
| Example 3 | 30.7 | 0.95 | 0.24 | 0.20 | 0.20 | 2.00 | 0.04 | 0.15 | 0.83 |
| Example 4 | 30.7 | 0.95 | 0.30 | 0.20 | 0.20 | 2.00 | 0.04 | 0.15 | 0.67 |
| Comp. Example 3 | 30.7 | 0.95 | 0.42 | 0.20 | 0.20 | 2.00 | 0.04 | 0.15 | 0.48 |
| Comp. Example 3a | 30.7 | 0.95 | 0.20 | 0.05 | 0.20 | 2.00 | 0.04 | 0.15 | 0.25 |
| Example 5a | 30.7 | 0.95 | 0.20 | 0.08 | 0.20 | 2.00 | 0.04 | 0.15 | 0.40 |
| Example 5 | 30.7 | 0.95 | 0.20 | 0.10 | 0.20 | 2.00 | 0.04 | 0.15 | 0.50 |
| Example 6 | 30.7 | 0.95 | 0.20 | 0.15 | 0.20 | 2.00 | 0.04 | 0.15 | 0.75 |
| Example 2 | 30.7 | 0.95 | 0.20 | 0.20 | 0.20 | 2.00 | 0.04 | 0.15 | 1.00 |
| Example 7 | 30.7 | 0.95 | 0.20 | 0.25 | 0.20 | 2.00 | 0.04 | 0.15 | 1.25 |
| Example 8 | 30.7 | 0.95 | 0.20 | 0.30 | 0.20 | 2.00 | 0.04 | 0.15 | 1.50 |
| Comp. Example 3b | 30.7 | 0.95 | 0.20 | 0.35 | 0.20 | 2.00 | 0.04 | 0.15 | 1.75 |
| Comp. Example 4 | 30.7 | 0.95 | 0.20 | 0.20 | 0.02 | 2.00 | 0.04 | 0.15 | 1.00 |
| Example 9 | 30.7 | 0.95 | 0.20 | 0.20 | 0.04 | 2.00 | 0.04 | 0.15 | 1.00 |
| Example 10 | 30.7 | 0.95 | 0.20 | 0.20 | 0.08 | 2.00 | 0.04 | 0.15 | 1.00 |
| Example 11 | 30.7 | 0.95 | 0.20 | 0.20 | 0.12 | 2.00 | 0.04 | 0.15 | 1.00 |
| Example 12 | 30.7 | 0.95 | 0.20 | 0.20 | 0.16 | 2.00 | 0.04 | 0.15 | 1.00 |
| Example 2 | 30.7 | 0.95 | 0.20 | 0.20 | 0.20 | 2.00 | 0.04 | 0.15 | 1.00 |
| Example 13 | 30.7 | 0.95 | 0.20 | 0.20 | 0.24 | 2.00 | 0.04 | 0.15 | 1.00 |
| Example 13a | 30.7 | 0.95 | 0.20 | 0.20 | 0.50 | 2.00 | 0.04 | 0.15 | 1.00 |
| Comp. Example 5 | 30.7 | 0.95 | 0.20 | 0.20 | 1.00 | 2.00 | 0.04 | 0.15 | 1.00 |
| Comp. Example 6 | 30.7 | 0.95 | 0.20 | 0.20 | 0.20 | 0.40 | 0.04 | 0.15 | 1.00 |
| Example 14a | 30.7 | 0.95 | 0.20 | 0.20 | 0.20 | 0.50 | 0.04 | 0.15 | 1.00 |
| Example 14 | 30.7 | 0.95 | 0.20 | 0.20 | 0.20 | 0.80 | 0.04 | 0.15 | 1.00 |
| Example 15 | 30.7 | 0.95 | 0.20 | 0.20 | 0.20 | 1.20 | 0.04 | 0.15 | 1.00 |
| Example 16 | 30.7 | 0.95 | 0.20 | 0.20 | 0.20 | 1.60 | 0.04 | 0.15 | 1.00 |
| Example 2 | 30.7 | 0.95 | 0.20 | 0.20 | 0.20 | 2.00 | 0.04 | 0.15 | 1.00 |
| Example 17 | 30.7 | 0.95 | 0.20 | 0.20 | 0.20 | 2.40 | 0.04 | 0.15 | 1.00 |
| Example 18 | 30.7 | 0.95 | 0.20 | 0.20 | 0.20 | 3.00 | 0.04 | 0.15 | 1.00 |
| Comp. Example 7a | 30.7 | 0.95 | 0.20 | 0.20 | 0.20 | 2.00 | 0.01 | 0.15 | 1.00 |
| Example 19 | 30.7 | 0.95 | 0.20 | 0.20 | 0.20 | 2.00 | 0.02 | 0.15 | 1.00 |
| Example 2 | 30.7 | 0.95 | 0.20 | 0.20 | 0.20 | 2.00 | 0.04 | 0.15 | 1.00 |
| Example 20 | 30.7 | 0.95 | 0.20 | 0.20 | 0.20 | 2.00 | 0.06 | 0.15 | 1.00 |
| Example 21 | 30.7 | 0.95 | 0.20 | 0.20 | 0.20 | 2.00 | 0.08 | 0.15 | 1.00 |
| Example 22 | 30.7 | 0.95 | 0.20 | 0.20 | 0.20 | 2.00 | 0.10 | 0.15 | 1.00 |
| Comp. Example 7 | 30.7 | 0.95 | 0.20 | 0.20 | 0.20 | 2.00 | 0.15 | 0.15 | 1.00 |
| Comp. Example 8 | 30.7 | 0.95 | 0.20 | 0.20 | 0.20 | 2.00 | 0.04 | 0.04 | 1.00 |

TABLE 1-continued

| | | | | | | | | | |
|---|---|---|---|---|---|---|---|---|---|
| Comp. Example 9 | 30.7 | 0.95 | 0.20 | 0.20 | 0.20 | 2.00 | 0.04 | 0.08 | 1.00 |
| Example 24a | 30.7 | 0.95 | 0.20 | 0.20 | 0.20 | 2.00 | 0.04 | 0.10 | 1.00 |
| Example 24 | 30.7 | 0.95 | 0.20 | 0.20 | 0.20 | 2.00 | 0.04 | 0.12 | 1.00 |
| Example 2 | 30.7 | 0.95 | 0.20 | 0.20 | 0.20 | 2.00 | 0.04 | 0.15 | 1.00 |
| Example 25 | 30.7 | 0.95 | 0.20 | 0.20 | 0.20 | 2.00 | 0.04 | 0.18 | 1.00 |
| Example 26 | 30.7 | 0.95 | 0.20 | 0.20 | 0.20 | 2.00 | 0.04 | 0.21 | 1.00 |
| Example 27 | 30.7 | 0.95 | 0.20 | 0.20 | 0.20 | 2.00 | 0.04 | 0.25 | 1.00 |

| | Before Tb diffusion | | | | | Change amount due to Tb diffusion | |
|---|---|---|---|---|---|---|---|
| Sample number | Br (mT) | HcJ (kA/m) | Br, HcJ Evaluation | Hk/HcJ (%) | Corrosion resistance Evaluation | ΔBr (mT) | ΔHcJ (kA/m) |
| Comp. Example 1 | 1454 | 1176 | ○ | | ○ | −5 | 460.1 |
| Example 1 | 1453 | 1203 | ○ | | ○ | −3 | 601.7 |
| Example 1a | 1451 | 1210 | ○ | | ○ | −4 | 621.7 |
| Example 2 | 1444 | 1242 | ○ | | ○ | −3 | 686.9 |
| Example 3 | 1440 | 1253 | ○ | | ○ | −5 | 751.4 |
| Example 4 | 1430 | 1265 | ○ | | ○ | −8 | 781.7 |
| Comp. Example 3 | 1414 | 1281 | X | | ○ | −14 | 792.8 |
| Comp. Example 3a | 1444 | 1181 | X | | ○ | −18 | 706.8 |
| Example 5a | 1444 | 1201 | ○ | | ○ | −9 | 677.3 |
| Example 5 | 1444 | 1210 | ○ | | ○ | −6 | 663.1 |
| Example 6 | 1443 | 1230 | ○ | | ○ | −4 | 651.9 |
| Example 2 | 1444 | 1242 | ○ | | ○ | −3 | 686.9 |
| Example 7 | 1441 | 1252 | ○ | | ○ | −4 | 668.6 |
| Example 8 | 1435 | 1290 | ○ | | ○ | −7 | 654.3 |
| Comp. Example 3b | 1424 | 1308 | ○ | | ○ | −11 | 633.0 |
| Comp. Example 4 | 1445 | 1102 | X | | ○ | −13 | 437.8 |
| Example 9 | 1445 | 1223 | ○ | | ○ | −8 | 632.0 |
| Example 10 | 1445 | 1240 | ○ | | ○ | −6 | 654.3 |
| Example 11 | 1442 | 1238 | ○ | | ○ | −5 | 661.5 |
| Example 12 | 1442 | 1244 | ○ | | ○ | −5 | 663.1 |
| Example 2 | 1444 | 1242 | ○ | | ○ | −3 | 686.9 |
| Example 13 | 1441 | 1250 | ○ | | ○ | −2 | 676.6 |
| Example 13a | 1436 | 1258 | ○ | | ○ | −3 | 672.5 |
| Comp. Example 5 | 1425 | 1149 | X | | ○ | −11 | 652.0 |
| Comp. Example 6 | 1442 | 1233 | ○ | | X | −5 | 670.2 |
| Example 14a | 1442 | 1230 | ○ | | ○ | −4 | 663.0 |
| Example 14 | 1444 | 1239 | ○ | | ○ | −2 | 677.4 |
| Example 15 | 1443 | 1233 | ○ | | ○ | −4 | 671.8 |
| Example 16 | 1445 | 1245 | ○ | | ○ | −3 | 660.7 |
| Example 2 | 1444 | 1242 | ○ | | ○ | −3 | 686.9 |
| Example 17 | 1443 | 1250 | ○ | | ○ | −6 | 656.7 |
| Example 18 | 1444 | 1230 | ○ | | ○ | −4 | 667.0 |
| Comp. Example 7a | 1434 | 1230 | X | | ○ | −1 | 597.0 |
| Example 19 | 1445 | 1245 | ○ | | ○ | −4 | 663.1 |
| Example 2 | 1444 | 1242 | ○ | | ○ | −3 | 686.9 |
| Example 20 | 1443 | 1240 | ○ | | ○ | −2 | 658.3 |
| Example 21 | 1444 | 1249 | ○ | | ○ | −3 | 654.3 |
| Example 22 | 1443 | 1245 | ○ | | ○ | −2 | 648.7 |
| Comp. Example 7 | 1439 | 1210 | X | | ○ | −7 | 592.5 |
| Comp. Example 8 | 1445 | 1182 | X | 82.4 | ○ | −14 | 663.1 |
| Comp. Example 9 | 1445 | 1211 | ○ | 87.9 | ○ | −8 | 659.1 |
| Example 24a | 1443 | 1209 | ○ | 98.2 | ○ | −5 | 662.2 |
| Example 24 | 1443 | 1221 | ○ | 99.0 | ○ | −3 | 671.8 |
| Example 2 | 1444 | 1242 | ○ | 99.2 | ○ | −3 | 686.9 |
| Example 25 | 1444 | 1250 | ○ | 99.1 | ○ | −4 | 652.7 |
| Example 26 | 1445 | 1278 | ○ | 99.4 | ○ | −3 | 679.0 |
| Example 27 | 1444 | 1299 | ○ | 99.2 | ○ | −2 | 662.3 |

TABLE 2

| | Composition of R-T-B magnet (before Tb diffusion) | | | | | | | | | |
|---|---|---|---|---|---|---|---|---|---|---|
| Sample number | Nd (mass %) | Dy (mass %) | B (mass %) | Al (mass %) | Ga (mass %) | Cu (mass %) | Co (mass %) | Mn (mass %) | Zr (mass %) | Ga/Al |
| Comp. Example 11 | 27.5 | 0.0 | 0.95 | 0.20 | 0.20 | 0.20 | 2.00 | 0.04 | 0.15 | 1.00 |
| Example 31 | 28.0 | 0.0 | 0.95 | 0.20 | 0.20 | 0.20 | 2.00 | 0.04 | 0.15 | 1.00 |
| Example 32 | 28.5 | 0.0 | 0.95 | 0.20 | 0.20 | 0.20 | 2.00 | 0.04 | 0.15 | 1.00 |
| Example 33 | 29.0 | 0.0 | 0.95 | 0.20 | 0.20 | 0.20 | 2.00 | 0.04 | 0.15 | 1.00 |
| Example 34 | 29.5 | 0.0 | 0.95 | 0.20 | 0.20 | 0.20 | 2.00 | 0.04 | 0.15 | 1.00 |

TABLE 2-continued

| | | | | | | | | | | |
|---|---|---|---|---|---|---|---|---|---|---|
| Example 35 | 30.0 | 0.0 | 0.95 | 0.20 | 0.20 | 0.20 | 2.00 | 0.04 | 0.15 | 1.00 |
| Example 36 | 30.5 | 0.0 | 0.95 | 0.20 | 0.20 | 0.20 | 2.00 | 0.04 | 0.15 | 1.00 |
| Example 2 | 30.7 | 0.0 | 0.95 | 0.20 | 0.20 | 0.20 | 2.00 | 0.04 | 0.15 | 1.00 |
| Example 37 | 31.0 | 0.0 | 0.95 | 0.20 | 0.20 | 0.20 | 2.00 | 0.04 | 0.15 | 1.00 |
| Example 38 | 31.5 | 0.0 | 0.95 | 0.20 | 0.20 | 0.20 | 2.00 | 0.04 | 0.15 | 1.00 |
| Comp. Example 12 | 32.0 | 0.0 | 0.95 | 0.20 | 0.20 | 0.20 | 2.00 | 0.04 | 0.15 | 1.00 |
| Comp. Example 13 | 30.7 | 0.0 | 0.80 | 0.20 | 0.20 | 0.20 | 2.00 | 0.04 | 0.15 | 1.00 |
| Example 39 | 30.7 | 0.0 | 0.85 | 0.20 | 0.20 | 0.20 | 2.00 | 0.04 | 0.15 | 1.00 |
| Example 40 | 30.7 | 0.0 | 0.90 | 0.20 | 0.20 | 0.20 | 2.00 | 0.04 | 0.15 | 1.00 |
| Example 2 | 30.7 | 0.0 | 0.95 | 0.20 | 0.20 | 0.20 | 2.00 | 0.04 | 0.15 | 1.00 |
| Example 41 | 30.7 | 0.0 | 1.00 | 0.20 | 0.20 | 0.20 | 2.00 | 0.04 | 0.15 | 1.00 |
| Comp. Example 14 | 30.7 | 0.0 | 1.05 | 0.20 | 0.20 | 0.20 | 2.00 | 0.04 | 0.15 | 1.00 |
| Example 2 | 30.7 | 0.0 | 0.95 | 0.20 | 0.20 | 0.20 | 2.00 | 0.04 | 0.15 | 1.00 |
| Example 43 | 29.7 | 1.0 | 0.95 | 0.20 | 0.20 | 0.20 | 2.00 | 0.04 | 0.15 | 1.00 |
| Example 44 | 28.7 | 2.0 | 0.95 | 0.20 | 0.20 | 0.20 | 2.00 | 0.04 | 0.15 | 1.00 |

| | Before Tb diffusion | | | | Change amount due to Tb diffusion | |
|---|---|---|---|---|---|---|
| Sample number | Br (mT) | HcJ (kA/m) | Br, HcJ Evaluation | Corrosion resistance Evaluation | ΔBr (mT) | ΔHcJ (kA/m) |
| Comp. Example 11 | 1458 | 1008 | X | ○ | −5 | 680.4 |
| Example 31 | 1467 | 1087 | ○ | ○ | −4 | 677.3 |
| Example 32 | 1472 | 1122 | ○ | ○ | −3 | 662.0 |
| Example 33 | 1470 | 1156 | ○ | ○ | −4 | 640.8 |
| Example 34 | 1462 | 1181 | ○ | ○ | −3 | 652.0 |
| Example 35 | 1455 | 1202 | ○ | ○ | −2 | 650.0 |
| Example 36 | 1451 | 1211 | ○ | ○ | −3 | 667.0 |
| Example 2 | 1444 | 1242 | ○ | ○ | −3 | 686.9 |
| Example 37 | 1441 | 1269 | ○ | ○ | −4 | 690.2 |
| Example 38 | 1430 | 1277 | ○ | ○ | −3 | 679.5 |
| Comp. Example 12 | 1422 | 1275 | X | ○ | −12 | 682.7 |
| Comp. Example 13 | 1440 | 1002 | X | ○ | −13 | 600.7 |
| Example 39 | 1444 | 1280 | ○ | ○ | −8 | 690.5 |
| Example 40 | 1446 | 1292 | ○ | ○ | −3 | 700.2 |
| Example 2 | 1444 | 1242 | ○ | ○ | −3 | 686.9 |
| Example 41 | 1437 | 1228 | ○ | ○ | −3 | 612.3 |
| Comp. Example 14 | 1429 | 1204 | X | ○ | −5 | 550.3 |
| Example 2 | 1444 | 1242 | ○ | ○ | −3 | 686.9 |
| Example 43 | 1421 | 1395 | ○ | ○ | −4 | 642.1 |
| Example 44 | 1380 | 1571 | ○ | ○ | 0 | 682.0 |

From Table 1, Table 2, FIG. 1, and FIG. 2, all Examples have favorable residual magnetic flux density Br and coercivity HcJ before the Tb diffusion and exhibit favorable corrosion resistance before the Tb diffusion. In addition, all Examples have a favorable squareness ratio. Furthermore, in all Examples, the decrease value of residual magnetic flux density Br due to Tb diffusion was small, and the increment value of coercivity HcJ due to Tb diffusion was large. In contrast, in all Comparative Examples, one or more of Br and HcJ before Tb diffusion, squareness ratio before Tb diffusion, decrease value of residual magnetic flux density Br due to Tb diffusion, increment value of coercivity HcJ due to Tb diffusion, and corrosion resistance were unfavorable.

Figure 3:
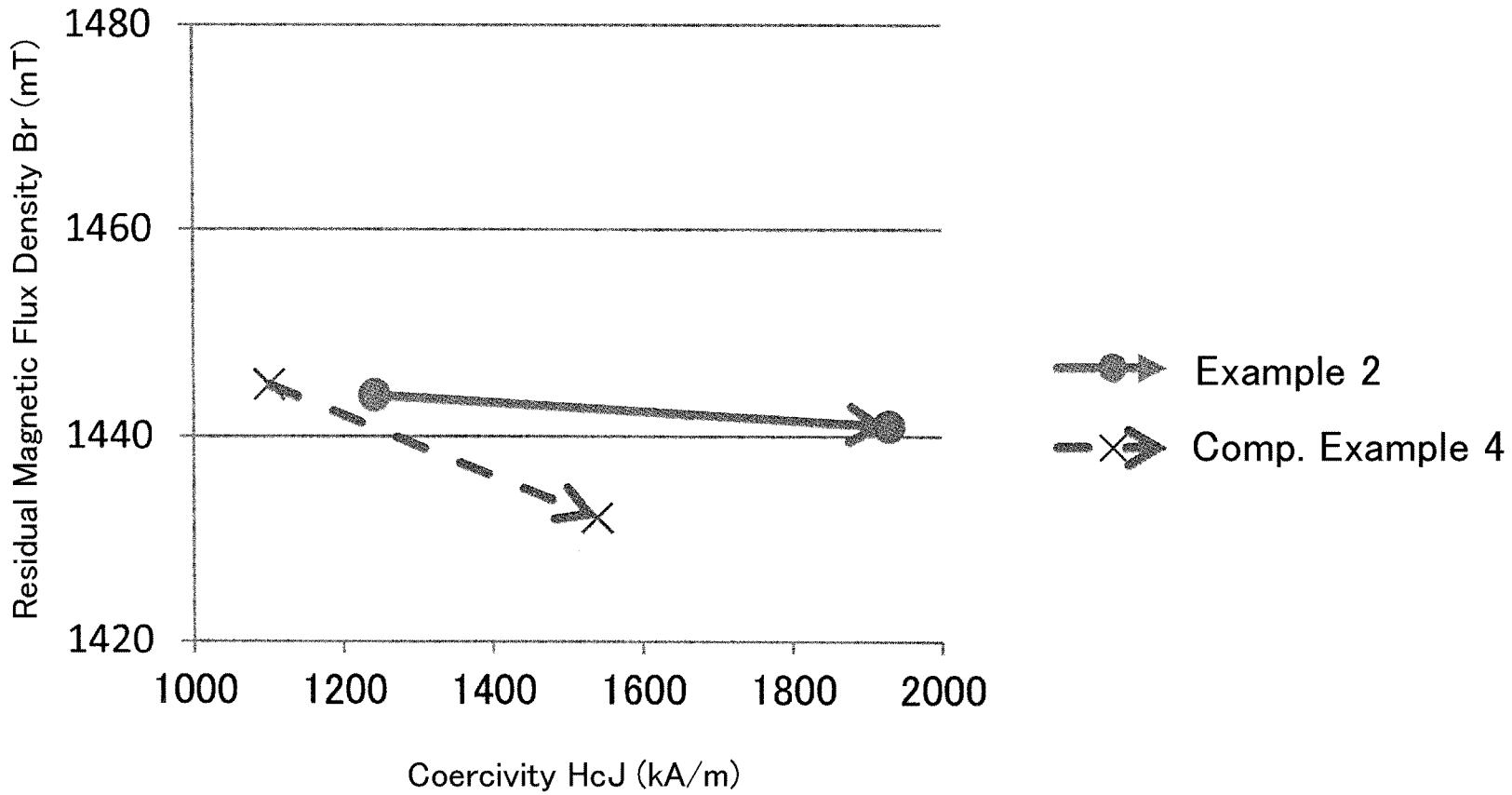
FIG. 3 is a graph representing change in magnetic properties before and after the grain boundary diffusion in Experimental Example 1.

For example, FIG. 3 is a graph that compares Example 2 and Comparative Example 4. FIG. 3 is a graph having arrows drawn from the magnetic properties before Tb diffusion to the magnetic properties after Tb diffusion. It is clear from this graph that Example 2 has more excellent magnetic properties before Tb diffusion, a smaller decrease value of residual magnetic flux density Br after Tb diffusion, and a larger increment value of coercivity HcJ than those of Comparative Example 4.

Experimental Example 2

A diffusion test was conducted by changing diffusion conditions. For Experimental Example 2, a base material "A" as a sintered body of Example was fabricated, and base materials "a" and "b" as a sintered body of Comparative Examples were fabricated. The compositions of each base material are shown in Table 3. The respective base materials were fabricated in the same manner as Experimental Example 1.

TABLE 3

| | Composition of R-T-B based sintered magnet | | | | | | | | | Before Tb diffusion | | |
|---|---|---|---|---|---|---|---|---|---|---|---|---|
| Base material number | Nd (mass %) | B (mass %) | Al (mass %) | Ga (mass %) | Cu (mass %) | Co (mass %) | Mn (mass %) | Zr (mass %) | Ga/Al | Br (mT) | HcJ (kA/m) | Br, HcJ Evaluation |
| Base material "A" | 31.0 | 0.92 | 0.22 | 0.15 | 0.15 | 1.00 | 0.06 | 0.20 | 0.68 | 1450 | 1285 | ○ |
| Base material "a" | 31.0 | 0.92 | 0.22 | 0.15 | 0.02 | 1.00 | 0.12 | 0.20 | 0.68 | 1446 | 1224 | ○ |

TABLE 3-continued

| Base material number | Composition of R-T-B based sintered magnet | | | | | | | | | Before Tb diffusion | | |
|---|---|---|---|---|---|---|---|---|---|---|---|---|
| | Nd (mass %) | B (mass %) | Al (mass %) | Ga (mass %) | Cu (mass %) | Co (mass %) | Mn (mass %) | Zr (mass %) | Ga/Al | Br (mT) | HcJ (kA/m) | Br, HcJ Evaluation |
| Base material "b" | 31.0 | 0.92 | 0.22 | 0.15 | 0.02 | 1.00 | 0.16 | 0.20 | 0.68 | 1441 | 1188 | X |

It is found from Table 3 that the base material "A" and the base material "a" have favorable residual magnetic flux density Br, coercivity HcJ, and corrosion resistance before Tb diffusion. In contrast, it is found from Table 3 that the base material "b" has unfavorable residual magnetic flux density Br and coercivity HcJ before Tb diffusion.

Furthermore, a slurry containing $TbH_2$ grains was coated on the base materials "A", "a", and "b" so that the mass ratio of Tb to the mass of the magnet was 0.3 mass %, a Tb diffusion was conducted by changing diffusion conditions, and the trend of residual magnetic flux density Br and coercivity HcJ were measured. As a result, Table 4 was obtained. Furthermore, a slurry containing $TbH_2$ grains was coated so that the mass ratio of Tb to the mass of the magnet was 0.6 mass %, and a Tb diffusion was conducted by changing diffusion conditions. As a result, Table 5 was obtained.

It is found from Table 4 and Table 5 that the decrease value of residual magnetic flux density Br due to the Tb diffusion was smaller and the increment value of coercivity HcJ due to the Tb diffusion was larger in Example using the base material "A" even if changing coating amount of slurry, diffusion time, and diffusion temperature, compared with Comparative Examples using the base material "a" and the base material "b".

Experimental Example 3

In Example 2 and Comparative Example 1, the properties of the base material were evaluated by changing the second aging temperature T2. The results are shown in Table 6 and FIG. 4.

TABLE 4

| Diffusion time (h) | Diffusion temperature (° C.) | ΔBr (mT) | | | ΔHcJ (kA/m) | | |
|---|---|---|---|---|---|---|---|
| | | Base material "A" | Base material "a" | Base material "b" | Base material "A" | Base material "a" | Base material "b" |
| 18 | 950 | −2 | −7 | −4 | 497 | 438 | 465 |
| | 930 | −2 | −8 | −5 | 552 | 478 | 498 |
| 24 | 950 | −2 | −10 | −7 | 494 | 438 | 478 |
| | 930 | −2 | −8 | −6 | 557 | 488 | 505 |
| | 900 | −1 | −7 | −4 | 592 | 462 | 486 |
| | 880 | −1 | −6 | −3 | 572 | 409 | 415 |
| 30 | 930 | −4 | −10 | −8 | 553 | 509 | 509 |
| | 900 | −3 | −9 | −6 | 600 | 509 | 501 |
| 36 | 900 | −4 | −12 | −10 | 599 | 517 | 509 |
| | 880 | −2 | −13 | −11 | 606 | 523 | 497 |

TBH2 coating amount: 0.3 mass %

TABLE 5

| Diffusion time (h) | Diffusion temperature (° C.) | ΔBr (mT) | | | ΔHcJ (kA/m) | | |
|---|---|---|---|---|---|---|---|
| | | Base material "A" | Base material "a" | Base material "b" | Base material "A" | Base material "a" | Base material "b" |
| 18 | 950 | −3 | −12 | −10 | 681 | 583 | 653 |
| | 930 | −3 | −10 | −9 | 696 | 601 | 661 |
| 24 | 950 | −4 | −14 | −13 | 704 | 538 | 665 |
| | 930 | −4 | −10 | −10 | 692 | 586 | 669 |
| | 900 | −3 | −7 | −7 | 728 | 589 | 634 |
| | 880 | −2 | −6 | −6 | 688 | 587 | 619 |
| 30 | 930 | −4 | −13 | −10 | 715 | 595 | 669 |
| | 900 | −4 | −9 | −9 | 732 | 599 | 646 |
| 36 | 900 | −4 | −10 | −9 | 704 | 610 | 649 |
| | 880 | −3 | −8 | −13 | 702 | 654 | 605 |

TBH2 coating amount: 0.6 mass %

TABLE 6

| Second aging temperature T2 (° C.) | Example 2 HcJ (kA/m) | Comp. Example 1 HcJ (kA/m) |
|---|---|---|
| 470 | 1240 | 1161 |
| 500 | 1255 | 1200 |
| 520 | 1242 | 1176 |
| 560 | 1228 | 1121 |

Figure 4:
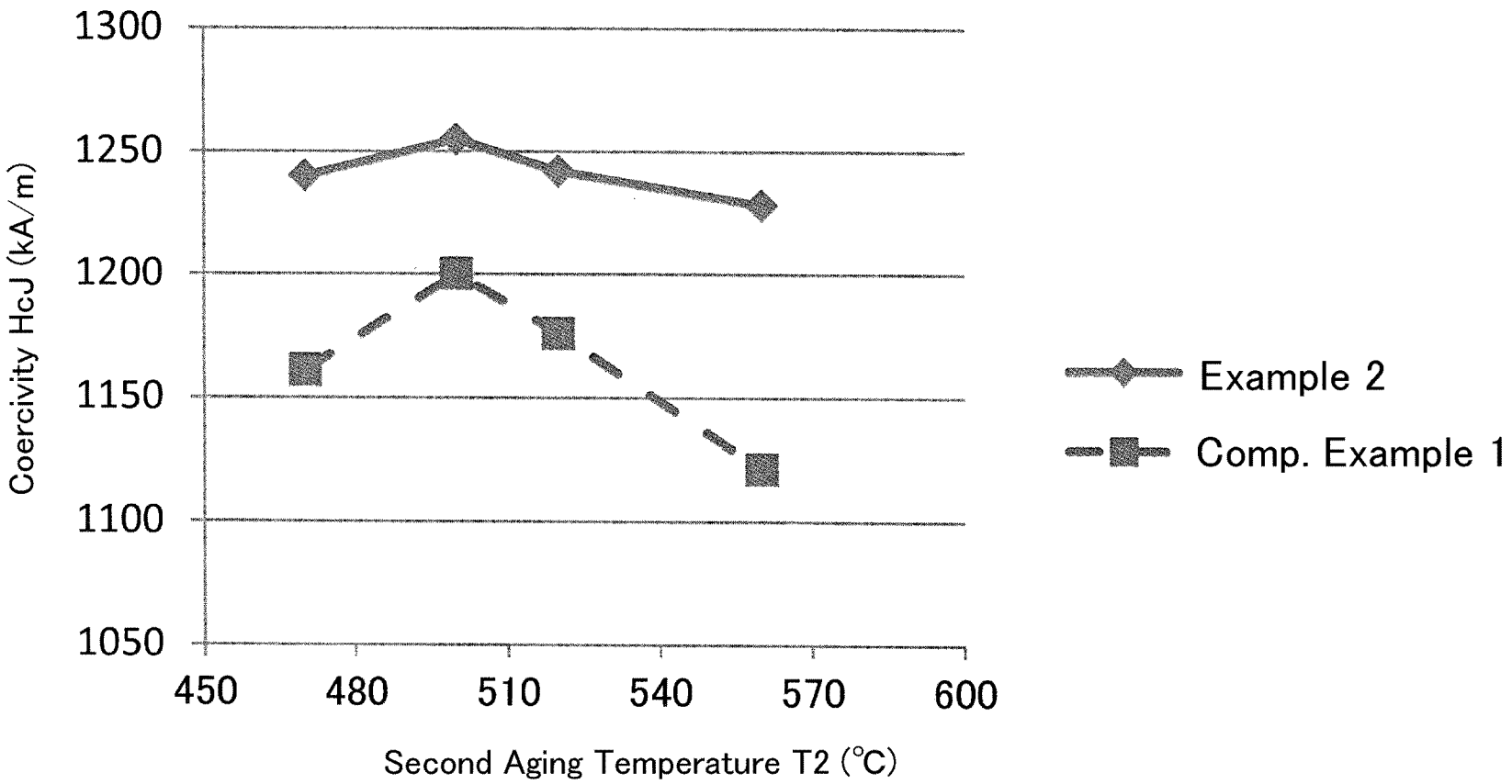
FIG. 4 is a diagram illustrating the relation between the coercivity HcJ and the second aging temperature in Experimental Example 3.

It is found from Table 6 and FIG. 4 that the property change (HcJ change) to the change of the second aging temperature T2 was smaller in Example 2, where the composition of Al etc. was within the range of the present invention, compared with Comparative Example 1, where the content of Al was too small.

Experimental Example 4

The diffusion temperature at the time of grain boundary diffusion was changed with respect to the R-T-B based sintered magnets of Example 2 and Comparative Example 1, and the change values (ΔBr, ΔHcJ) of residual magnetic flux density Br and coercivity HcJ before and after the grain boundary diffusion were evaluated. The results are shown in Table 7, FIG. 5, and FIG. 6.

TABLE 7

| Diffusion | Example 2 | | Comp. Example 1 | |
|---|---|---|---|---|
| temperature | ΔBr (mT) | ΔHcJ (kA/m) | ΔBr (mT) | ΔHcJ (kA/m) |
| 850 | 0 | 659 | −1 | 378 |
| 900 | −2 | 677 | −3 | 422 |
| 930 | −3 | 687 | −5 | 460 |
| 950 | −4 | 673 | −5 | 456 |

Figure 5:
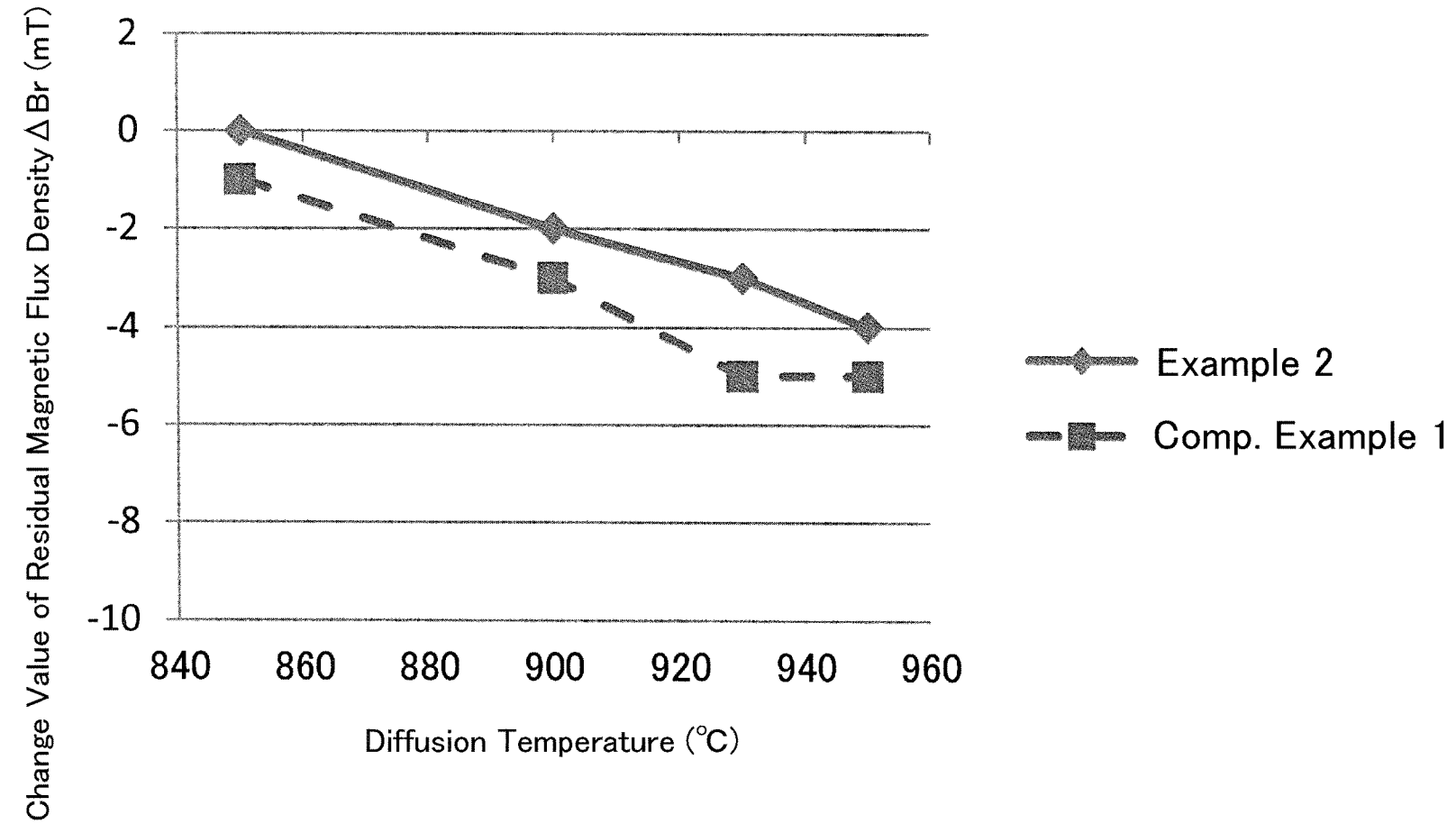
FIG. 5 is a diagram illustrating the relation between a change value of residual magnetic flux density Br and a diffusion temperature in Experimental Example 4.
Figure 6:
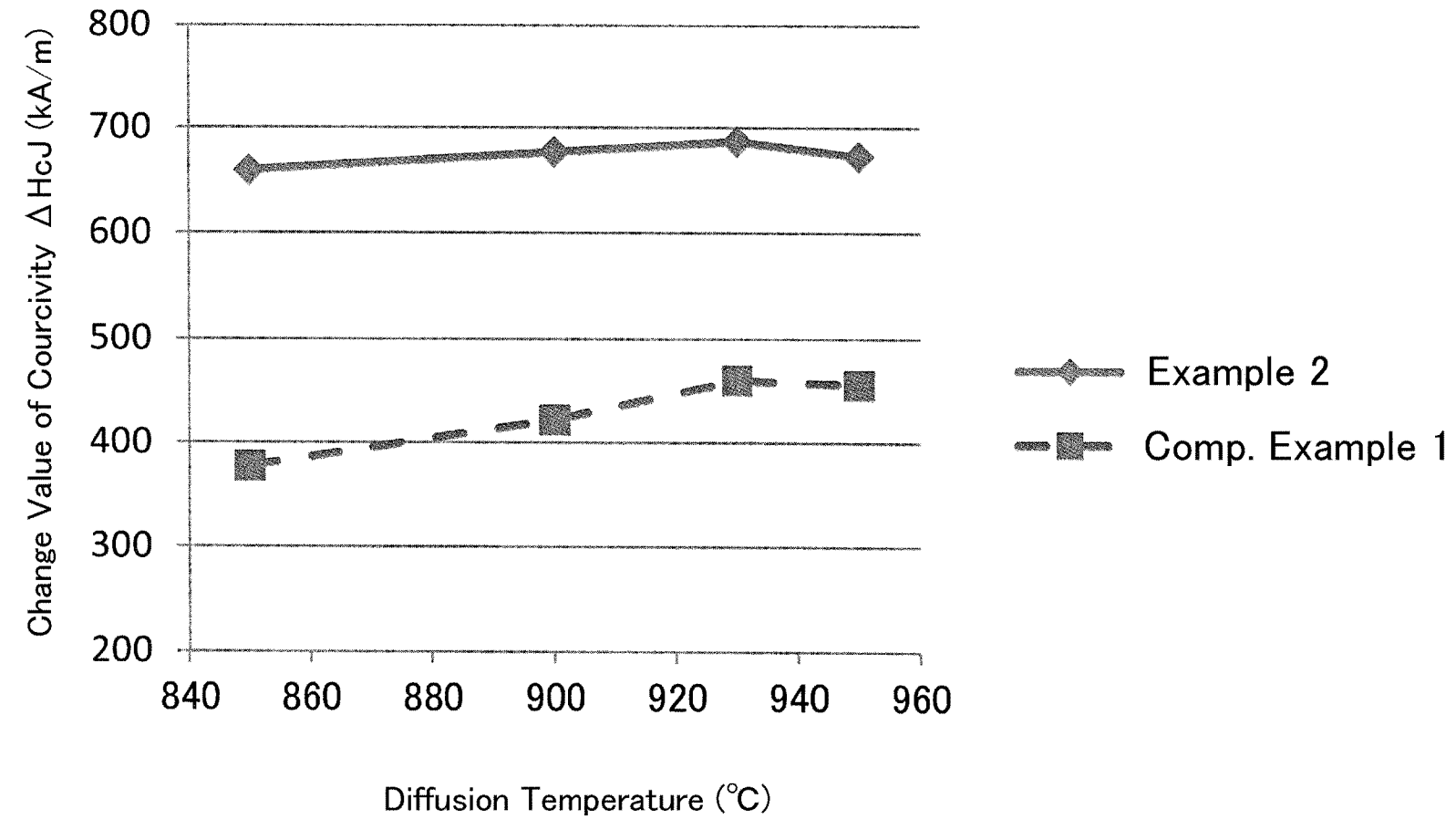
FIG. 6 is a diagram illustrating the relation between a change value of coercivity HcJ and a diffusion temperature in Experimental Example 4.

It is found from Table 7, FIG. 5, and FIG. 6 that ΔBr and ΔHcJ to the change in the diffusion temperature were smaller in Example 2, where the composition of Al etc. was within the range of the present invention, compared with Comparative Example 1, where the content of Al was too small.

The invention claimed is:

1. An R-T-B based sintered magnet comprising "R", "T", and "B", wherein

"R" represents a rare earth element,

"T" represents a metal element other than rare earth elements including at least Fe, Cu, Mn, Al, Co, Ga, and Zr, "B" represents boron or boron and carbon, a content of "R" is 28.0 to 31.5 mass % with respect to 100 mass % of a total mass of the R-T-B based sintered magnet, a content of Cu is 0.04 to 0.50 mass % with respect to 100 mass % of a total mass of the R-T-B based sintered magnet, a content of Mn is 0.02 to 0.10 mass % with respect to 100 mass % of a total mass of the R-T-B based sintered magnet, a content of Al is 0.15 to 0.30 mass % with respect to 100 mass % of a total mass of the R-T-B based sintered magnet, a content of Co is 0.50 to 3.0 mass % with respect to 100 mass % of a total mass of the R-T-B based sintered magnet, a content of Ga is 0.08 to 0.30 mass % with respect to 100 mass % of a total mass of the R-T-B based sintered magnet, a content of Zr is 0.10 to 0.25 mass % with respect to 100 mass % of a total mass of the R-T-B based sintered magnet, and a content of "B" is 0.85 to 1.0 mass % with respect to 100 mass % of a total mass of the R-T-B based sintered magnet.

2. The R-T-B based sintered magnet according to claim 1, wherein "R" comprises a heavy rare earth element consisting of substantially only Dy.

3. The R-T-B based sintered magnet according to claim 1, wherein "R" does not substantially comprise a heavy rare earth element.

4. The R-T-B based sintered magnet according to claim 1, wherein Ga/Al is 0.60 or more and 1.30 or less by mass ratio.

5. The R-T-B based sintered magnet according to claim 2, wherein Ga/Al is 0.60 or more and 1.30 or less by mass ratio.

6. The R-T-B based sintered magnet according to claim 3, wherein Ga/Al is 0.60 or more and 1.30 or less by mass ratio.

7. The R-T-B based sintered magnet according to claim 1, wherein a heavy rare earth element is dispersed in a grain boundary of the R-T-B based sintered magnet.

* * * * *